US008173913B2

(12) United States Patent
Wilkolaski

(10) Patent No.: US 8,173,913 B2
(45) Date of Patent: May 8, 2012

(54) NORMALLY CLOSED DOME SWITCH

(75) Inventor: Edward A. Wilkolaski, Lancaster, NY (US)

(73) Assignee: Curbell Medical Products, Inc., Orchard Park, NY (US)

( * ) Notice: Subject to any disclaimer, the term of this patent is extended or adjusted under 35 U.S.C. 154(b) by 226 days.

(21) Appl. No.: 12/732,889

(22) Filed: Mar. 26, 2010

(65) Prior Publication Data

US 2011/0233037 A1 Sep. 29, 2011

(51) Int. Cl.
*H01H 9/26* (2006.01)

(52) U.S. Cl. ..... 200/5 A

(58) Field of Classification Search ..... 200/5 A, 200/6 A, 406, 304, 329, 512, 516, 275, 521
See application file for complete search history.

(56) References Cited

U.S. PATENT DOCUMENTS 4,476,355 A * 10/1984 Mital ..... 200/5 A
4,771,139 A * 9/1988 DeSmet ..... 200/5 A
7,230,197 B2 * 6/2007 Sano et al. ..... 200/406
7,381,913 B2 * 6/2008 Sjostrom ..... 200/5 A

* cited by examiner

*Primary Examiner* — Edwin A. Leon
(74) *Attorney, Agent, or Firm* — Hodgson Russ LLP

(57) ABSTRACT

A normally closed dome switch comprises a printed circuit board including a switch trace having first and second contact areas electrically insulated from one another, and a conductive switch dome having a central portion spaced from the printed circuit board and a plurality of contacting portions extending from the central portion such that each of the first and second contact areas is contacted by at least one of the contacting portions when the switch dome is unpressed such that the unpressed switch dome forms a closed switch between the first and second contact areas. The switch dome is resiliently pressable to urge the central portion toward the printed circuit board and pivot the contacting portions about a corresponding fulcrum to remove the plurality of contacting portions of the switch dome from contact with at least one of the first and second contact areas to open the switch.

10 Claims, 4 Drawing Sheets

NORMALLY CLOSED DOME SWITCH

FIELD OF THE INVENTION

The present invention is generally directed to electronic devices incorporating so-called "dome" switches in connection with a pushbutton control panel of the device. By way of non-limiting example, the electronic device may be a hand-held pillow speaker kept at a patient's bedside for remotely controlling a television, room lights, or other electronic items in the room, and for communicating with nursing staff or other personnel.

BACKGROUND OF THE INVENTION

Normally closed (dry contact) switch operation is a requirement for some nurse call devices. Previous nurse call devices used tact or pushbutton switches, and therefore providing a normally closed switch that opens upon actuation has not been problematic.

However, newer generation nurse call devices use metallic dome switches. A nurse call device using dome switches is described in commonly-owned U.S. patent application Ser. No. 12/362,501, now U.S. Patent Application Publication No. 2010/0195295 A1, the disclosure of which is incorporated herein by reference. Metallic dome switches of the prior art are designed as normally open switches, such that the switch is closed upon actuation. In normally open dome switches of the prior art, a printed circuit board includes a switch trace having a ring-shaped first contact area and a central second contact area located within the ring of the first contact area and spaced from the first contact area so as to be electrically insulated from the first contact area, and a metallic dome is arranged to have its support legs in contact with the first contact area and its central portion spaced above the second contact portion. In this arrangement, the switch can be closed by pressing the central portion of the metallic dome sufficiently to cause the central portion to contact the second contact area of the switch trace on the printed circuit board. When pressure on the dome is released, the dome resiliently returns to its original position and the switch is re-opened.

What is needed is a normally closed dome switch that opens when the dome is pressed.

SUMMARY OF THE INVENTION

The present invention provides a normally closed dome switch. The switch comprises a printed circuit board including a switch trace thereon. The switch trace has a first contact area and a second contact area spaced from the first contact area so as to be electrically insulated from the first contact area. The switch further comprises a conductive switch dome having a central portion spaced from the printed circuit board and a plurality of contacting portions extending from the central portion such that each of the first contact area and the second contact area is contacted by at least one of the contacting portions of the switch dome when the switch dome is unpressed. Consequently, the unpressed switch dome forms a closed switch between the first contact area and the second contact area. The switch dome is resiliently pressable to urge the central portion of the switch dome toward the printed circuit board and remove the plurality of contacting portions of the switch dome from contact with at least one of the first contact area and the second contact area to open the switch between the first contact area and the second contact area when the switch dome is pressed.

In one embodiment of the invention, the first contact area of the switch trace includes a first pair of electrically connected arc-shaped segments arranged about a central axis of the switch dome, the second contact area of the switch trace includes a second pair of electrically connected arc-shaped segments also arranged about the central axis of the switch dome, and the switch dome includes four contacting portions respectively associated with the first and second pairs of arc-shaped segments. A spacer layer adhered to the printed circuit board has cut-out regions over the arc-shaped segments of the switch trace and provides a fulcrum radially adjacent each arc-shaped segment such that when the central portion of the switch dome is pressed toward the printed circuit board, each of the contacting portions is pivoted about the fulcrum out of contact with the corresponding first or second contact area of the switch trace.

In another embodiment, the first and second contact areas of the switch trace are outer and inner rings concentric about a central axis of the switch dome, and fulcrums are provided on the switch dome itself. When the switch dome is unpressed, the contacting portions of the switch dome touch the outer first contact area while the corresponding fulcrums provided on the switch dome touch the inner second contact area, thereby forming a closed switch between the first and second contact portions. When the switch dome is pressed, each of the contacting portions is pivoted about the fulcrum out of contact with the outer first contact area of the switch trace, thereby opening the switch between the first and second contact areas.

DETAILED DESCRIPTION OF THE INVENTION

Figure 1:
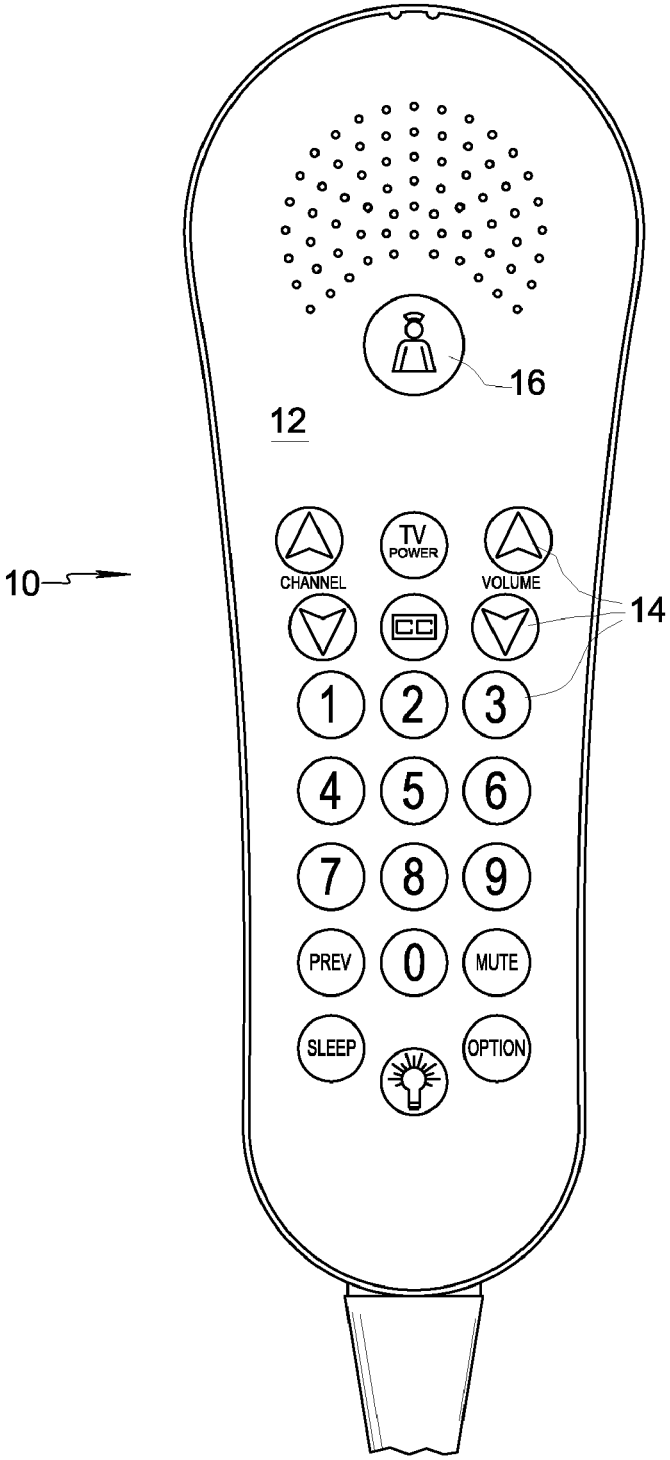
FIG. 1 is a top plan view of an electrical device, in particular a hospital pillow speaker, embodying the present invention.

FIG. 1 shows a hospital pillow speaker 10 formed in accordance with an embodiment of the present invention. Pillow speaker 10 is an electronic device for use in a health care setting, such as a hospital, nursing home, clinic, or similar environment. While the present invention is described with respect to a hospital pillow speaker, it will be understood that the present invention may be embodied in other types of electronic devices that use pressable "dome" switches for user control.

Pillow speaker 10 includes a polyester overlay 12 having a plurality of graphics corresponding to various pushbutton controls 14 and 16 operable by a user. In the pillow speaker shown in FIG. 1, reference numeral 16 corresponds to a nurse call button providing communication with a remote nurse station, and reference numerals 14 correspond to buttons for operating a television and room lights in the patient's hospital room. Nurse call button 16 differs from the other control buttons 14 in that nurse call button 16 is a normally closed dome switch in accordance with the present invention, whereas the other control buttons 14 are normally open dome switches. In the context of the present specification, "normally closed" means that the switch is closed when the control button is unpressed, and the switch is opened when a user presses the control button. In the context of the present specification, "normally open" means that the switch is open when the control button is unpressed, and the switch is closed when a user presses the control button. As mentioned above, the present invention concerns a normally closed dome switch.

Figure 2:
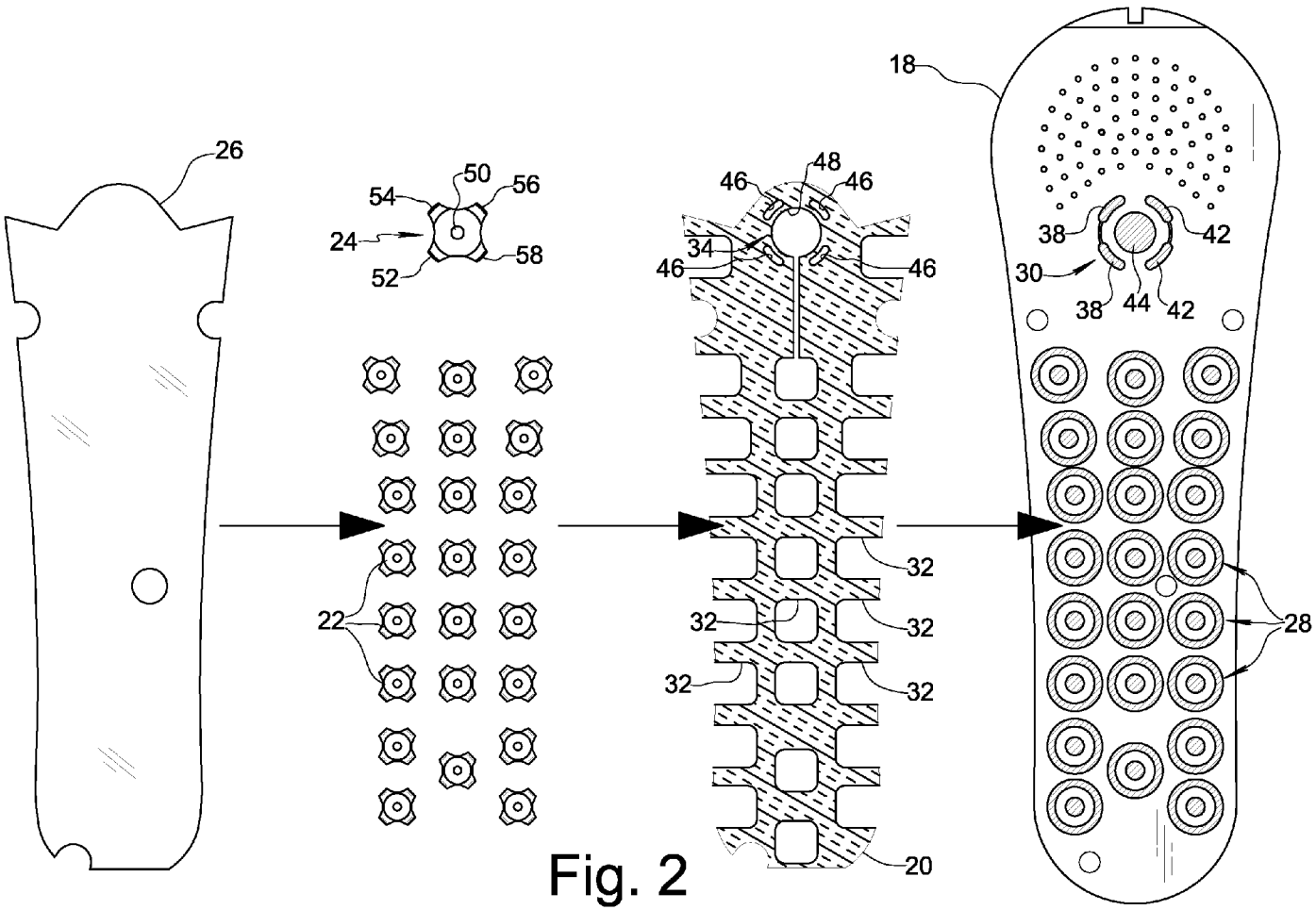
FIG. 2 is a schematic assembly view showing a printed circuit board, a spacer layer, a plurality of metallic switch domes, and a dome retainer of the electronic device in greater detail.

Reference is now made to FIG. 2, which shows a printed circuit board 18, a spacer layer 20, a plurality of metallic switch domes 22 and 24, and a dome retainer 26 of pillow speaker 10. Printed circuit board 18 includes a plurality of electrically conductive switch traces 28 respectively associated with switch domes 22 to form a plurality of normally open dome switches in accordance a known configuration of the prior art as described in the Background section of this specification. These normally open dome switches correspond to pushbutton controls 14 described above in connection with FIG. 1.

Printed circuit board 18 further includes an electrically conductive switch trace 30 associated with switch dome 24 to form a normally closed dome switch in accordance with an embodiment of the present invention. This normally closed dome switch corresponds to the nurse call pushbutton control 16 described above in connection with FIG. 1.

Spacer layer 20 may be a polyester layer having adhesive on its underside surface facing printed circuit board 18 to adhere the spacer layer to the printed circuit board. Spacer layer 20 may have an electrical insulation voltage rating greater than 25 kV, however this property is subject to design choice depending upon the specific application. Spacer layer 20 includes a plurality of openings 32 aligned with switch traces 28, and another opening 34 aligned with switch trace 30. Dome retainer 26 includes a non-adhesive top surface and an adhesive bottom surface that is adhered over the switch domes 22, 24 and the spacer layer 20 to hold the switch domes in place.

Figure 3:
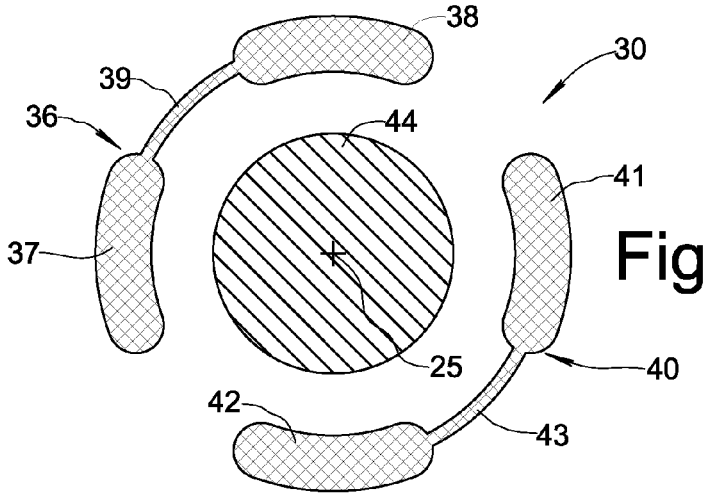
FIG. 3 is an enlarged top plan view of a switch trace formed on a printed circuit board in accordance with an embodiment of the present invention.

Reference is now made to FIG. 3, which shows switch trace 30 in enlarged view. Switch trace 30 includes a first contact area 36 and a second contact area 40 spaced from the first contact area 36 so as to be electrically insulated from the first contact area 36. In the embodiment shown, first contact area 36 includes a first pair of arc-shaped segments 37, 38 arranged about a central axis 25 of switch dome 24 (see FIG. 5A) and electrically connected to one another by a trace line 39 on printed circuit board 18. Similarly, the second contact area 40 of switch trace 30 includes a second pair of arc-shaped segments 41, 42 arranged about central axis 25 and electrically connected to one another by a trace line 43 on printed circuit board 18. Switch trace may also include a central area 44 for possible use in forming a normally open switch, as discussed more fully below, when an alternative device design calls for a normally open dome switch in place of a normally closed dome switch of the present invention.

Figure 4:
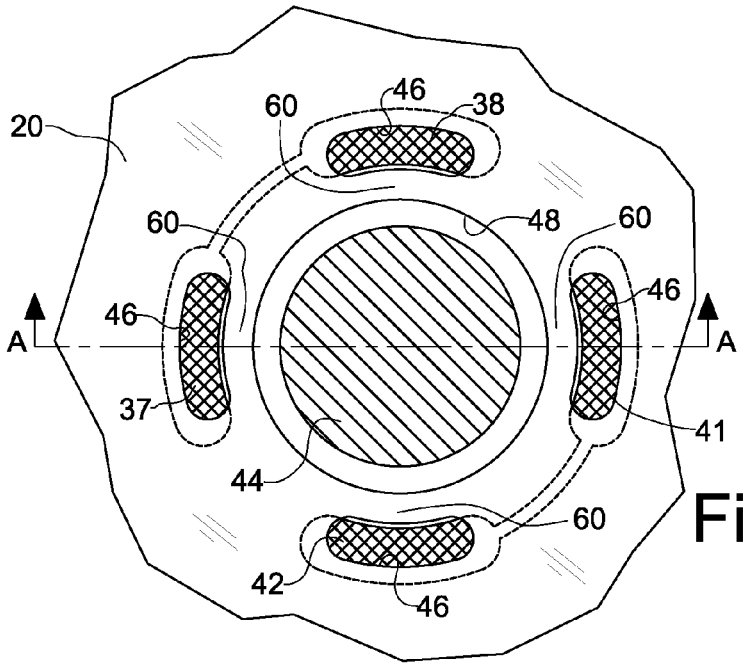
FIG. 4 is an enlarged top plan view similar to that of FIG. 3, however the switch trace is shown partially covered by a spacer layer.

FIG. 4 shows spacer layer 20 arranged overtop printed circuit board 18 in the region of switch trace 30. As may be seen, opening 34 of spacer layer 20 includes four cut-out regions 46 each registering with a respective arc-shaped segment 37, 38, 41, or 42 of switch trace 30. Spacer layer 20 provides a plurality of fulcrums 60 located radially adjacent cut-out regions 46 in the direction of central axis 25. Spacer layer 20 may also include a central cut-out region 48 registering with central area 44.

Figure 5A:
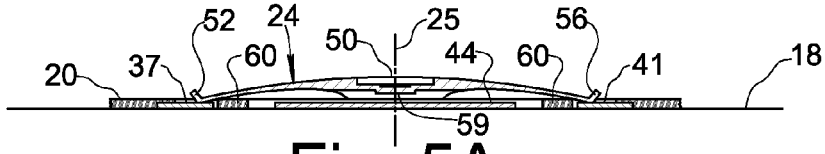
FIG. 5A is an enlarged cross-sectional view taken generally along the line A-A in FIG. 4 and additionally showing a metallic switch dome over the spacer layer and the switch trace to form a normally closed dome switch, wherein the switch dome is unpressed.
Figure 5B:
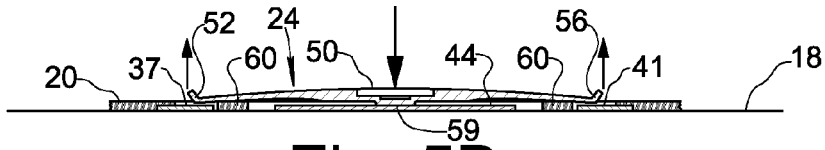
FIG. 5B is a view similar to that of FIG. 5A, wherein the switch dome is pressed.

Switch dome 24, shown in FIGS. 2, 5A, and 5B, includes a central portion 50 spaced from the printed circuit board 18 and a plurality of contacting portions 52, 54, 56, and 58 extending from the central portion 50. It is noted that in FIGS. 5A and 5B, the thickness (height) of areas 37, 41, and 44 of switch trace 30 is exaggerated for sake of illustration. When switch dome 24 is in an unpressed condition as depicted in FIG. 5A, first contact area 36 is contacted by contacting portions 52 and 54 which extend through cut-out regions 46 to touch the first pair of arc-shaped segments 37 and 38, respectively. Likewise, second contact area 40 is contacted by contacting portions 56 and 58 of switch dome 24 which extend through cut-out regions 46 to touch the second pair of arc-shaped segments 41 and 42, respectively. Thus, when switch dome 24 is unpressed as shown in FIG. 5A, it forms a closed switch between first contact area 36 and second contact area 40.

FIG. 5B shows switch dome 24 when it is pressed, for example when a patient presses nurse call button 16. Switch dome 24 is resiliently pressable to urge central portion 50 of the switch dome toward printed circuit board 18 and remove the plurality of contacting portions 52, 54, 56, and 58 of switch dome from contact with at least one of the first contact area 36 and the second contact area 40 to open the switch between first contact area 36 and second contact area 40 when switch dome 24 is pressed. In the present embodiment, fulcrums 60 provided by spacer layer 20 are engaged by switch dome 24 such that contacting portions 52, 54, 56, and 58 are caused to pivot upward away from contact with arc-shaped segments 37 and 38 of first contact area 36 and away from contact with arc-shaped segments 41 and 42 of second contact area 40 when central portion 50 of the switch dome is pressed as shown in FIG. 5B. While the present embodiment is designed such that all four contacting portions 52, 54, 56, and 58 lift away from the contact areas of switch trace 30, it will be understood that the switch may be opened by a design that causes contacting portions 52 and 54 to be removed from contact with first contact area 36 while contacting portions 56 and 58 remain in contact with second contact area 40, or by a design that causes contacting portions 56 and 58 to be removed from contact with second contact area 40 while contacting portions 52 and 54 remain in contact with first contact area 36. What is important for opening the switch is that switch dome 24 is removed from contact with at least one of the first and second contact portions 36 and 40 when it is pressed.

As mentioned above, switch trace 30 may include central area 44 exposed by central cut-out region 48 in spacer layer 20. While the central area 44 is not part of the normally closed dome switch design of the present embodiment, it may be provided as part of a generic switch trace pattern that further includes surrounding arc-shaped segments 37, 38, 41, and 42. In order to change switch trace 30 for use in a normally open dome switch, the four arc-shaped segments 37, 38, 41, and 42 could be shorted together by adding two more trace lines (not shown) between arc-shaped segments 38 and 41 and between arc-shaped segments 42 and 37, thereby electrically connecting all four arc-shaped segments together to provide a new first contact area in the form of an outer ring. Central area 44 could then act as a new second contact area. Fulcrums 60 could be removed, such that pressing the central portion 50 of switch dome 24 until a central contacting portion 59 on the underside of central portion 50 contacts central area 44 would close a switch between the outer ring formed by connected arc-shaped segments 37, 38, 41, and 42 on the one hand, and the central area 44 on the other. In this way, a generic switch trace pattern may be provided and easily directed into either a normally closed dome switch of the present invention, or a normally open dome switch of the prior art, by specifying the arrangement of trace lines between arc-shaped segments 37, 38, 41, and 42. The same metallic switch dome 24 may be used to form either type of switch.

Figure 6:
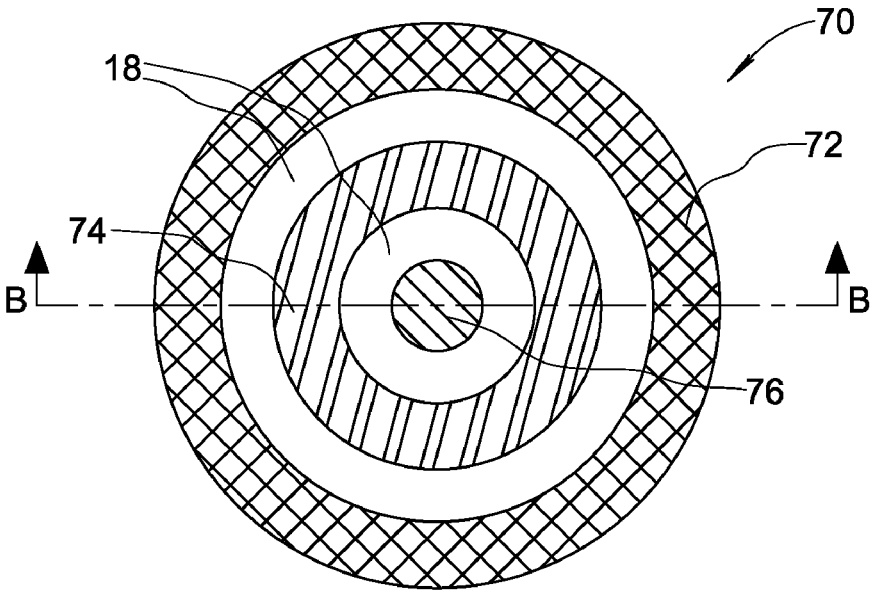
FIG. 6 is an enlarged top plan view of a switch trace formed on a printed circuit board in accordance with another embodiment of the present invention.
Figure 7A:
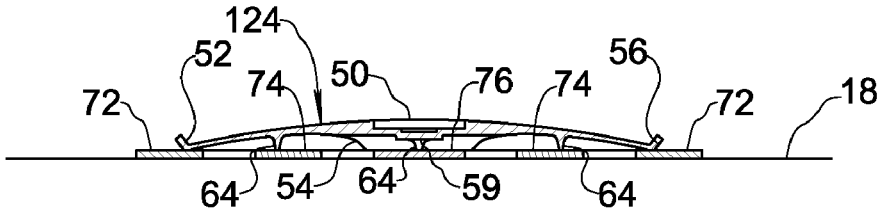
FIG. 7A is an enlarged cross-sectional view taken generally along the line B-B in FIG. 6 and additionally showing a metallic switch dome over the switch trace to form a normally closed dome switch, the switch dome being provided with a plurality of fulcrums, wherein the switch dome is unpressed.
Figure 7B:
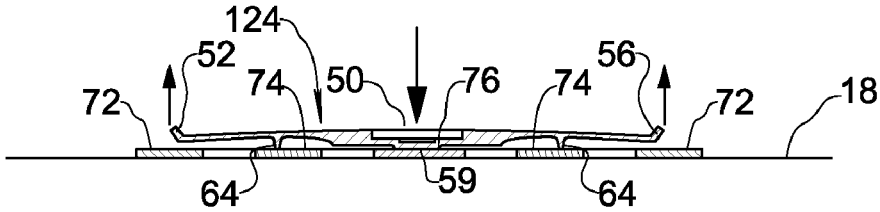
FIG. 7B is a view similar to that of FIG. 7A, wherein the switch dome is pressed to open the switch.

A normally closed dome switch formed in accordance with another embodiment of the present invention will now be described with reference to FIGS. 6, 7A, and 7B. The normally closed dome switch comprises a switch trace 70 on printed circuit board 18 that includes a first contact area 72 and a second contact area 74 in the form of concentric rings, the second contact area 74 being arranged within first contact area 72 and spaced radially from the first contact area. Switch trace 70 may also include a central area 76 arranged within second contact area 74 and spaced radially from the second contact area. It is noted that in FIGS. 7A and 7B, the thickness (height) of areas 72, 74, and 76 of switch trace 70 is exaggerated for sake of illustration.

The switch also comprises a metallic switch dome 124 that is similar to switch dome 24 of the first embodiment in that it includes a central portion 50 spaced from printed circuit board 18 and a plurality of contacting portions 52, 54, 56, and 58 (see FIG. 2) extending from central portion 50. However, switch dome 124 differs from switch dome 24 in that it includes a plurality of fulcrums 64 each associated with a respective contacting portion 52, 54, 56, and 58. Fulcrums 64, which may be integrally formed as part of metallic switch dome 124, depend downwardly from an underside of the switch dome to contact second contact area 74 of switch trace 70. When switch dome 124 is unpressed, as shown in FIG. 7A, its contacting portions 52, 54, 56, and 58 touch first contact area 72 of switch trace 70. Thus, in the unpressed condition, metallic switch dome 124 acts as a closed switch between first contact area 72 and second contact area 74. To open the switch, the central portion 50 of switch dome 124 is pressed as shown in FIG. 7B such that contacting portions 52, 54, 56, and 58 are caused to pivot upward about fulcrums 64 and away from contact with first contact area 72.

Metallic switch dome 124 may also include a central contacting portion 59 on the underside of the switch dome. When switch dome 124 is unpressed, as shown in FIG. 7A, central contacting portion 59 is directly above central area 76, but does not make contact with central area 76. As may be seen in FIG. 7B, central contacting portion 59 makes contact with central area 76 of switch trace 70 when switch dome 124 is pressed. In this way, a normally open dome switch may easily be provided between first contact area 72 and central contact area 76 using the same metallic switch dome if design requirements call for a normally open dome switch instead of a normally closed dome switch of the present invention.

Modifications and other embodiments of the inventions set forth herein will be apparent to one skilled in the art to which these inventions pertain in light of teachings presented in the present specification. Therefore, the inventions are not to be limited to the specific embodiments disclosed, and modifications and other embodiments are intended to be included within the scope of the appended claims.

PARTS LIST

10 Electronic device (pillow speaker)
12 Overlay
14 Pushbutton controls
16 Pushbutton control (nurse call button)
18 Printed circuit board (PCB)
20 Spacer layer
22 Switch dome for pushbutton controls 14
24 Switch dome for pushbutton control 16
25 Central axis of switch dome 24
26 Dome retainer
28 Switch traces on PCB for pushbutton controls 14
30 Switch trace on PCB for pushbutton control 16
32 Openings in spacer layer 20 for pushbutton controls 14
34 Opening in spacer layer 20 for pushbutton control 16
36 First contact area of switch trace 30
37 Arc-shaped segment of first contact area 36
38 Arc-shaped segment of first contact area 36
39 Trace line on PCB between segments 37 and 38
40 Second contact area of switch trace 30
41 Arc-shaped segment of second contact area 40
42 Arc-shaped segment of second contact area 40
43 Trace line on PCB between segments 41 and 42
44 Central area of switch trace 30
46 Cut-out regions in spacer layer 20 (part of opening 34)
48 Central cut-out region in spacer layer 20 (part of opening 34)
50 Central portion of switch domes 24 and 124
52 Contacting portion of switch domes 24 and 124
54 Contacting portion of switch domes 24 and 124
56 Contacting portion of switch domes 24 and 124
58 Contacting portion of switch domes 24 and 124
59 Central contacting portion of switch domes 24 and 124
60 Fulcrums provided by spacer layer 20
64 Fulcrums provided as part of switch dome 124
70 Switch trace for pushbutton control 16 (other embodiment)
72 First contact area of switch trace 70
74 Second contact area of switch trace 70
76 Central area of switch trace 70
124 Switch dome for pushbutton control 16 (other embodiment)

What is claimed is:

1. An electrical switch apparatus comprising:

a printed circuit board including a switch trace thereon, the switch trace having a first contact area and a second contact area spaced from the first contact area so as to be electrically insulated from the first contact area;

a conductive switch dome having a central portion spaced from the printed circuit board and a plurality of contacting portions extending from the central portion;

wherein each of the first contact area and the second contact area is contacted by at least one of the plurality of contacting portions of the switch dome when the switch dome is unpressed such that the unpressed switch dome forms a closed switch between the first contact area and the second contact area; and wherein the switch dome is resiliently pressable to urge the central portion of the switch dome toward the printed circuit board and remove the plurality of contacting portions of the switch dome from contact with at least one of the first contact area and the second contact area to open the switch between the first contact area and the second contact area when the switch dome is pressed.

2. The electrical switch apparatus according to claim 1, wherein the first contact area of the switch trace and the second contact area of the switch trace each include an arc-shaped segment about a central axis of the switch dome.

3. The electrical switch apparatus according to claim 2, wherein the first contact area of the switch trace includes a first pair of electrically connected arc-shaped segments about the central axis of the switch dome, and the second contact area of the switch trace includes a second pair of electrically connected arc-shaped segments about the central axis of the switch dome.

4. The electrical switch apparatus according to claim 3, wherein the plurality of contacting portions of the switch dome includes four contacting portions respectively associated with the first and second pairs of arc-shaped segments.

5. The electrical switch apparatus according to claim 1, wherein a fulcrum is associated with each of the plurality of contacting portions of the switch dome, such that when the central portion of the switch dome is pressed toward the printed circuit board each of the plurality of contacting portions is pivoted out of contact with the corresponding first or second contact area.

6. The electrical switch apparatus according to claim 5, wherein the fulcrum is provided by a spacer layer adhered to the printed circuit board.

7. The electrical switch apparatus according to claim 5, wherein the fulcrum is part of the switch dome.

8. An electrical device comprising:

a printed circuit board including a switch trace thereon, the switch trace having a first contact area and a second contact area spaced from the first contact area so as to be electrically insulated from the first contact area;

a conductive switch dome having a central portion spaced from the printed circuit board and a plurality of contacting portions extending from the central portion;

a spacer layer adhered to the printed circuit board, the spacer layer having a plurality of cutout regions corresponding to the first contact area and the second contact area, wherein the spacer layer defines at least one fulcrum associated with a respective one of the plurality of contacting portions;

wherein each of the first contact area and the second contact area is contacted by at least one of the plurality of contacting portions of the switch dome when the switch dome is unpressed such that the unpressed switch dome forms a closed switch between the first contact area and the second contact area; and wherein the switch dome is resiliently pressable to urge the central portion of the switch dome toward the printed circuit board and pivot the respective contacting portion of the switch dome out of contact with the corresponding first or second contact area to open the switch between the first contact area and the second contact area when the switch dome is pressed.

9. The electrical device according to claim 8, wherein:

the first contact area of the switch trace includes a first pair of electrically connected arc-shaped segments about the central axis of the switch dome, and the second contact area of the switch trace includes a second pair of electrically connected arc-shaped segments about the central axis of the switch dome;

the plurality of contacting portions of the switch dome includes four contacting portions respectively associated with the first and second pairs of arc-shaped segments; and the spacer layer includes four arc-shaped cutout regions registering with the first and second pairs of arc-shaped segments, wherein a non-cutout region of the spacer layer adjacent each of the four arc-shaped cutout regions defines the fulcrum associated with one of the four contacting portions of the switch dome.

10. The electrical device according to claim 8, wherein the electrical device is a hospital pillow speaker, and the switch dome is associated with a nurse call button of the hospital pillow speaker.

* * * * *